United States Patent [19]

Hakluytt et al.

[11] 4,048,797

[45] Sept. 20, 1977

[54] COMBUSTION APPARATUS

[75] Inventors: John Philip Dabbs Hakluytt, Botley, near Southampton; John Ronald Tilston, Farnham, both of England

[73] Assignee: The Secretary of State for Defence in Her Britannic Majesty's Government of the United Kingdom of Great Britain and Northern Ireland, London, England

[21] Appl. No.: 638,106

[22] Filed: Dec. 5, 1975

[30] Foreign Application Priority Data

Dec. 6, 1974 United Kingdom ..... 52934/74

[51] Int. Cl.[2] ..... F02G 1/00

[52] U.S. Cl. ..... 60/39.72 R; 431/350

[58] Field of Search ..... 60/39.72 R; 431/3, 4, 431/350, 351, 352

[56] References Cited

U.S. PATENT DOCUMENTS

| | | | |
|---|---|---|---|
| 1,536,176 | 5/1925 | Aldrich | 60/39.72 R UX |
| 2,592,110 | 4/1952 | Berggren et al. | 60/39.72 R X |
| 3,030,773 | 4/1962 | Johnson | 60/39.72 R X |
| 3,817,690 | 6/1974 | Bryce et al. | 60/39.72 R X |
| 3,831,375 | 8/1974 | Richard et al. | 60/39.72 R |

*Primary Examiner*—Alan Cohan
*Assistant Examiner*—Gerald A. Michalsky
*Attorney, Agent, or Firm*—Cameron, Kerkam, Sutton, Stowell & Stowell

[57] ABSTRACT

The present invention provides gas turbine reheat combustion apparatus for aircraft propulsion. The apparatus includes means for producing a flame stabilization zone in a stream of combustion supporting gas flowing in a duct, said stabilization zone having a recirculatory flow region therein, an injector for introducing a fluid comprising an inert diluent such as, for example, nitrogen, into the recirculatory flow region, and means for supplying the fluid to the injector.

7 Claims, 2 Drawing Figures

COMBUSTION APPARATUS

This invention relates to combustion apparatus and particularly though not exclusively, relates to gas turbine reheat combustion apparatus for aircraft propulsion.

It is well known that the thrust of an aircraft gas turbine engine may be augmented by burning additional fuel in the exhaust gas stream of the engine as it flows through the jet pipe thereof. Thrust augmentation by this method is termed reheat or afterburning. Usually fixed baffles are mounted in the jet pipe to produce turbulent flow zones in their wake wherein combustion of the additional fuel can be maintained. Such baffles are usually termed flame stabilisers.

As the additional fuel flow rate is increased, the thrust of the engine increases until a point is reached at which smooth combustion of the additional, or reheat, fuel, in the wake of the flame stabilisers changes to unstable or rough combustion. Reheat combustion enstability may, in severe cases, result in mechanical failure of the engine.

The present invention is directed towards reducing or eliminating combustion instability.

According to the present invention, combustion apparatus includes means for producing a flame stabilisation zone in a stream of combustion supporting gas flowing in a duct, said stabilisation zone having a recirculatory flow region therein, an injector for introducing a fluid comprising an inert diluent into the recirculatory flow region, and means for supplying the fluid to the injector.

The injector may comprise a slot extending transversely relative to the direction of flow and is arranged to inject fluid into the centre of the recirculatory flow region. Alternatively, the injector may comprise a series of nozzles.

The duct may comprise the reheat duct of a reheat gas turbine engine and the fluid may comprise burnt gases from the turbine efflux.

An embodiment of the invention will now be described by way of example only and with reference to the drawings accompanying the provisional specification, which are schematic, of which:

Figure 1:
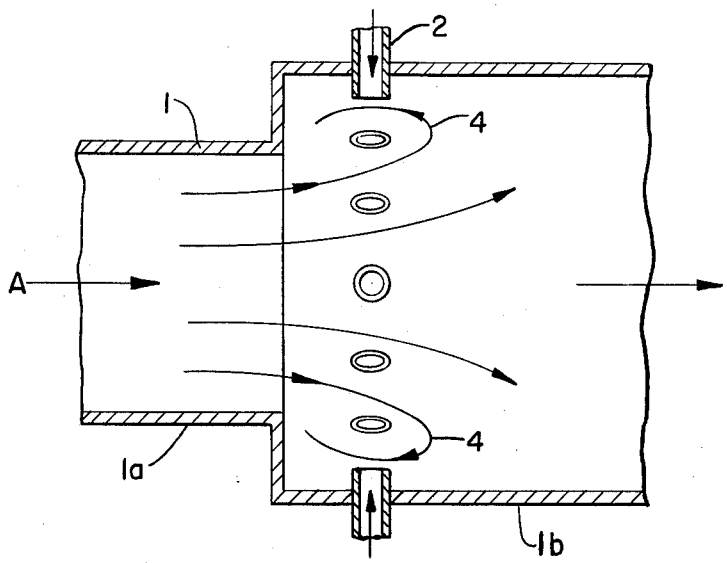
FIG. 1 shows a combustor according to the invention.

The combustor of FIG. 1 includes a duct 1 having a cylindrical upstream portion 1*a* and a cylindrical downstream portion 1*b* of enlarged diameter, there being a step change of section between the portion 1*a*, 1*b*. A series of radially directed injector pipes 2 are located in a plane between the step change of section and the downstream termination of a recirculatory flow region 4 which is formed when gas flows in the direction A through the duct. The injector pipes are connected to a constant pressure source of burnt combustion gases (not shown).

In operation, a mixture of gaseous fuel and air flows through the duct and a flow pattern forms as shown in the drawing. The fuel and air mixture is ignited and a flame stabilised in a zone which includes the region 4. Under some conditions of operation the flame may exhibit combustion instability. The injection of burnt gases through the injector pipes 2 radially inwards into the recirculatory flow region at a low flow rate (e.g. 5 per cent of the duct gas flow rate) reduces the instability enabling smooth combustion to take place in the duct.

Figure 2:
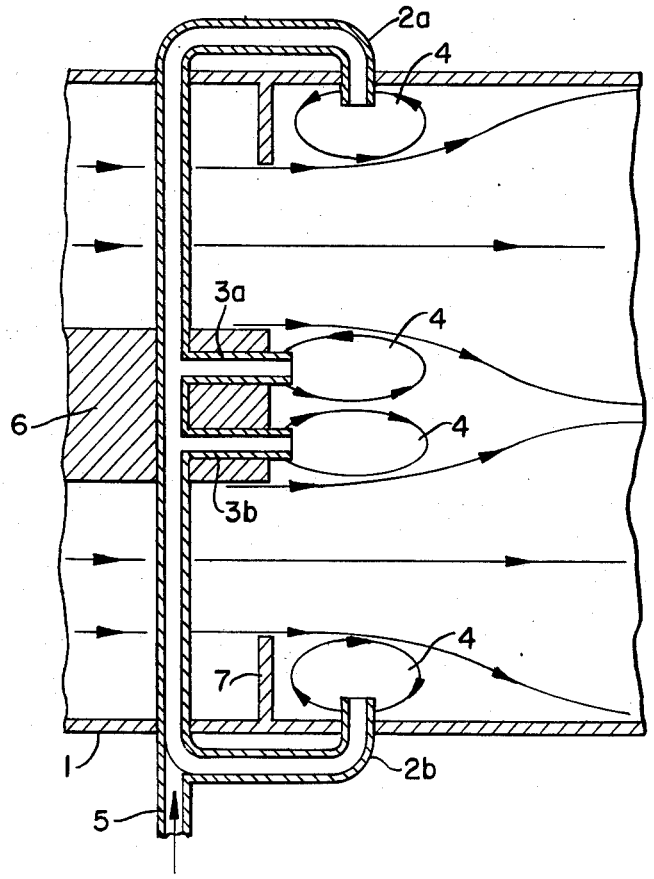
FIG. 2 shows another embodiment of the invention.

The combustor of FIG. 2 is a further development of that shown in FIG. 1 and operates in the same manner. The combustor has a series of radial injector pipes 2*a*, 2*b* (two shown only) and a series of axially arranged injector pipes, two of which are shown at 3*a* and 3*b*. Flame stabilisation zones are provided downstream of the downstream termination of a bluff body 6 disposed centrally with the duct 1 and an inwardly projecting lip 7. Burnt gases are fed into a manifold 5 serving all the injector pipes and are injected therefrom into the recirculatory flow regions 4.

The fluid injected into the recirculatory flow region may comprise diluents such as, for example, nitrogen, carbon dioxide, and helium but should not include reactive gases. The fluid may be stored in a pressurised container and connected to a supply pipe connected to the injectors.

We claim:

1. Combustion apparatus comprising a duct for conveying a stream of combustion supporting gas, means located within said duct providing a recirculatory flow of said gas which defines a flame stabilisation zone, and a source of fluid comprising an inert diluent connected to said duct for supplying said stabilisation zone with said inert diluent.

2. Combustion apparatus according to claim 1 wherein the fluid comprises nitrogen.

3. Combustion apparatus according to claim 1 wherein the fluid comprises carbon dioxide.

4. Combustion apparatus according to claim 1 wherein the fluid comprises helium.

5. Combustion apparatus comprising a duct for conveying a stream of combustion supporting gas, a bluff body having a step change of section at the downstream end thereof, said body inducing a recirculatory flow of said gas which defines a flame stabilisation zone immediately downstream of said body, a fluid injector in said duct for introducing a fluid comprising an inert diluent into said stabilisation zone, and a source of said fluid connected to said injector.

6. Combustion apparatus according to claim 5 wherein said fluid injector comprises a plurality of nozzles arranged to introduce said fluid into said stabilisation zone.

7. Combustion apparatus according to claim 5 wherein said fluid injector extends from the downstream end of said bluff body so as to introduce said fluid into the centre of said stabilisation zone.

* * * * *